US009869521B1

(12) United States Patent
Huang

(10) Patent No.: US 9,869,521 B1
(45) Date of Patent: Jan. 16, 2018

(54) GAS BLOCK FOR FIREARMS

(71) Applicant: George Huang, Henderson, NV (US)

(72) Inventor: George Huang, Henderson, NV (US)

( * ) Notice: Subject to any disclaimer, the term of this patent is extended or adjusted under 35 U.S.C. 154(b) by 14 days.

(21) Appl. No.: 14/449,178

(22) Filed: Aug. 1, 2014

(51) Int. Cl.
*F41A 5/18* (2006.01)
*F41A 5/26* (2006.01)

(52) U.S. Cl.
CPC . *F41A 5/18* (2013.01); *F41A 5/26* (2013.01)

(58) Field of Classification Search
CPC ..... F41A 5/18; F41A 5/28; F41A 5/30; F41A 5/26
USPC ..... 89/193
See application file for complete search history.

(56) References Cited

U.S. PATENT DOCUMENTS 3,527,194 A * 9/1970 Desrochers ..... F41B 11/62 124/37
5,945,626 A * 8/1999 Robbins ..... F41A 5/26 42/111
7,610,844 B2 * 11/2009 Kuczynko ..... F41A 5/28 89/193
7,856,917 B2 * 12/2010 Noveske ..... F41A 5/28 89/193
8,596,185 B1 * 12/2013 Soong ..... F41A 5/28 89/193
8,887,616 B2 * 11/2014 Kenney ..... F41A 5/28 89/193
8,950,313 B2 * 2/2015 Kenney ..... F41A 5/28 89/193
8,956,185 B2 * 2/2015 Lan ..... H01R 13/506 439/607.13
8,960,069 B1 * 2/2015 Soong ..... F41A 5/28 89/193
9,134,082 B2 * 9/2015 Brown ..... F41A 5/18
9,212,856 B2 * 12/2015 Baker ..... F41A 5/18
2007/0033851 A1 * 2/2007 Hochstrate ..... F41A 5/18 42/75.01
2008/0216375 A1 * 9/2008 Barrett ..... F41A 3/66 42/16

(Continued)

OTHER PUBLICATIONS

SLRrifleworks, SLR Rifleworks Sentury Adjustable Gas Block—NOw 4 versions in Titanium, Feb. 18, 2014, www.ar15.com/forums/t_3_124/638341_SLR_Rifleworks_New_SENTRY_Premium_Adjustable_Gas_Block.html, p. 1 of thread (which contains pp. 1-6).*

(Continued)

*Primary Examiner* — Michelle R Clement
*Assistant Examiner* — Bridget Cochran
(74) *Attorney, Agent, or Firm* — Shaddock Law Group, PC

(57) ABSTRACT

A gas block for a firearm that includes a body portion having a longitudinal axis; a barrel borehole, adapted to receive at least a portion of a barrel therethrough, extending through the body portion, along the longitudinal axis of the body portion; a gas tube extension portion having a longitudinal axis, wherein at least a portion of the gas tube extension portion extends beyond at least a portion of the body portion; a gas tube borehole extending through the gas tube extension portion, along the longitudinal axis of the gas tube extension portion, wherein the gas tube borehole is adapted to receive at least a portion of a gas tube therein; and a gas port disposed between the barrel borehole and the gas tube borehole, such that the barrel borehole is in fluid communication with the gas tube borehole.

18 Claims, 11 Drawing Sheets

(56) References Cited

U.S. PATENT DOCUMENTS

2010/0236396 A1* 9/2010 Stone ..... F41A 5/26 89/193
2010/0275770 A1* 11/2010 Noveske ..... F41A 5/28 89/193
2010/0319528 A1* 12/2010 Kenney ..... F41A 5/26 89/193
2011/0271827 A1* 11/2011 Larson ..... F41A 5/28 89/193
2012/0137870 A1* 6/2012 Lindsay ..... F41A 1/10 89/191.01
2012/0152104 A1* 6/2012 Audibert ..... F41A 5/18 89/191.01
2012/0167757 A1* 7/2012 Gomez ..... F41A 5/28 89/193
2013/0098235 A1* 4/2013 Reinken ..... F41A 5/28 89/193
2014/0000446 A1* 1/2014 Hall ..... F41A 19/03 89/129.01
2014/0076143 A1* 3/2014 Hall ..... F41A 19/03 89/129.01
2014/0076149 A1* 3/2014 Adams ..... F41A 5/28 89/192
2014/0150638 A1* 6/2014 Ricks ..... F41A 5/28 89/193
2014/0174285 A1* 6/2014 Baker ..... F41A 5/22 89/129.01
2015/0253091 A1* 9/2015 Gardner ..... F41A 5/28 89/193
2016/0084597 A1* 3/2016 Ricks ..... F41A 5/22 89/193

OTHER PUBLICATIONS

SLRrifleworks, SLR Rifleworks Sentury Adjustable Gas Block—NOw 4 versions in Titanium, Feb. 18, 2014, www.ar15.com/forums/t_3_124/638341_SLR_Rifleworks_New_SENTRY_Premium_Adjustable_Gas_Block.html, p. 3 of thread (which contains pp. 1-9).*

SLRrifleworks, SLR Rifleworks Sentury Adjustable Gas Block—NOw 4 versions in Titanium, Feb. 18, 2014, www.ar15.com/forums/t_3_124/638341_SLR_Rifleworks_New_SENTRY_Premium_Adjustable_Gas_Block.html, pp. 1 and 3 of thread (which contains pp. 1-9).*

* cited by examiner

GAS BLOCK FOR FIREARMS

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present invention relates to an improved, lightweight gas block for gas operated firearms.

2. Description of Related Art

A number of firearms operate based on a gas blowback system. One such firearm is the M-16, M-4, and AR-15 family of firearms.

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylinder between the bolt carrier and the bolt and drives the bolt carrier rearward.

The buffer, which is pushing on the rear of the bolt carrier group, is forced rearward by the bolt carrier group compressing the recoil spring. During this rearward movement, a cam track in the upper portion of the bolt carrier acts on the bolt cam pin, rotating the cam pin and bolt clockwise so that the bolt locking lugs are unlocked from the barrel extension locking lugs. As the rearward movement of the bolt carrier group continues, the empty cartridge case is extracted from the chamber, and ejected through the ejection port.

As the bolt carrier group clears the top of an inserted magazine and the empty cartridge case is expelled, a new round is pushed into the path of the bolt by the upward thrust of the magazine follower and spring.

As the bolt carrier group continues to move rearward, it overrides the hammer and forces the hammer down into the receiver, compressing the hammer spring, and allowing the rear hook of the hammer to engage with the hammer disconnect.

When the bolt carrier group reaches its rearmost position (when the rear of the buffer contacts the rear of the buffer tube), the compressed recoil spring expands, driving the buffer assembly forward with enough force to drive the bolt carrier group forward, toward the chamber, initiating chambering of the waiting round from the magazine into the chamber.

The forward movement of the bolt ceases when the locking lugs pass between the barrel extension locking lugs and the round is fully chambered. When the bolt carrier enters the final portion of its forward movement, the bolt cam pin emerges from the cam pin guide channel in the upper receiver and moves along the cam track, rotating the bolt counterclockwise. This rotation locks the bolt to the barrel extension (by interaction of the bolt locking lugs and the barrel extension locking lugs). The locking of the bolt completes the cycle of operation and, when the trigger is released, the rear hammer hook hammer slips from the disconnect and the front hammer hook is caught by the sear of the trigger. The firearm is then ready to be fired again.

Unfortunately, as this cycle occurs, heat is created and the barrel and the front sight (or gas block) expand. Because of the dissimilarities in the barrel and front sight (or gas block) these items expand and micro gaps are created between the barrel and the front sight (or gas block), allowing some of the gases that travel through the gas port in the barrel to escape between the barrel and front sight (or gas block). When this occurs, a certain amount of gas escapes and does not travel through the front sight (or gas block) gas port and into the gas tube. This can impair the firearm's ability to force the bolt carrier rearward and cycle reliably.

Furthermore, typical front sight gas blocks or replacement gas blocks are relatively heavy and bulky. This can cause difficulty if, for example, a user wishes to install a free float handguard having a reduced inner diameter and a length that extends beyond the gas block.

Any discussion of devices, documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

The various embodiments of the present invention relate to an improved, lightweight gas block for a firearm with features that reduce or eliminate the unwanted escape of gases between the barrel and the gas block.

In various exemplary, non-limiting embodiments, the gas block of the present invention includes a body portion having a longitudinal axis; a barrel borehole extending through the body portion, along the longitudinal axis of the body portion, wherein the barrel borehole is adapted to receive at least a portion of a barrel therethrough; a gas tube extension portion having a longitudinal axis, wherein at least a portion of the gas tube extension portion extends beyond at least a portion of the body portion; a gas tube borehole extending through the gas tube extension portion, along the longitudinal axis of the gas tube extension portion, wherein the gas tube borehole is parallel to the barrel borehole, and wherein the gas tube borehole is adapted to receive at least a portion of a gas tube therein; and a gas port disposed between the barrel borehole and the gas tube borehole, such that the barrel borehole is in fluid communication with the gas tube borehole.

The amount of material used to form the walls of the gas block (between the surface of the body portion and the surface of the barrel borehole) is reduced when compared to that of typical gas blocks. The gas block of the present invention is also shorter, or includes a shorter portion within the C-cut portion, than typical gas blocks. By having thinner walls and/or a shorter portion, the gas block of the present invention is able to flex during barrel expansion and contraction without a loss of the seal between the barrel and the barrel bore.

In various exemplary, nonlimiting embodiments, the gas block further comprises a roll pin borehole formed through the gas tube borehole, wherein a longitudinal axis of the roll pin borehole is perpendicular to the longitudinal axis of the gas tube extension portion.

In certain exemplary, nonlimiting embodiments, the gas block further comprises at least one weight-reducing groove formed in at least the body portion.

In various exemplary, nonlimiting embodiments, the gas block also includes a first setscrew aperture formed through the body portion, wherein the first set screw aperture is formed perpendicular to the barrel borehole.

According to other exemplary aspects of the present invention, the gas block further comprises a body extension portion extending beyond the body portion. In certain of these embodiments, a second set screw aperture is formed through the body extension portion, perpendicular to the barrel borehole.

In certain exemplary, nonlimiting embodiments, the gas tube extension portion and the body extension portion are separated by a C-cut portion. By including the concave, or C-cut portion, the weight of the gas block is reduced so that two setscrews can be used to secure the gas block, without significantly increasing the overall weight of the gas block. Additionally, a utilizing a curved, C-cut portion, an increased amount of the force exerted by the set screws on the bottom of a barrel can be transferred to the upper portion of the gas block, forcing the top of the barrel borehole down against the top of the barrel, creating a better seal between the top of the barrel and the barrel borehole, resulting in a better seal between the barrel gas port and the gas port of the gas block.

In essence, as the setscrews (and particularly the set screw in the body extension portion) are tightened to the barrel, the C-cut portion flexes and draws the gas block down against the barrel. This creates a superior seal, when compared to conventional gas block to barrel seals, and minimizes or eliminates gas leaks between the gas block and barrel.

Optionally, a first end of the body portion includes a planar surface portion and a concave surface portion, wherein a surface of the concave surface portion is perpendicular to the longitudinal axis of the body portion. If a concave surface portion is included, at least two nodes may be included that extend from the surface of the concave surface portion, wherein the nodes extend to a plane created by the planar surface portion of the first end of the gas block.

Accordingly, the presently disclosed invention provides a gas block that is lighter in weight and then a typical gas block.

The presently disclosed invention separately provides a gas block that has thinner walls than a typical gas block.

The presently disclosed invention separately provides a gas block that is generally shorter than a typical gas block.

The presently disclosed invention separately provides a gas block that has an ability to flex to compensate for firearm barrel expansion and contraction.

The presently disclosed invention separately provides a gas block that can be constructed using less material than a typical gas block.

The presently disclosed invention separately provides a gas block that can be secured by one or more sets screws or pins.

The presently disclosed invention separately provides a gas block that minimizes or eliminates gas leaks between the gas block and barrel.

The presently disclosed invention separately provides a gas block that can be attached with greater mechanical advantage than known gas blocks.

The presently disclosed invention separately provides a gas block that can be easily installed by a user.

These and other features and advantages of the presently disclosed upper receiver are described in or are apparent from the following detailed description of the exemplary, non-limiting embodiments.

BRIEF DESCRIPTION OF THE SEVERAL VIEWS OF THE DRAWINGS

As required, detailed embodiments of the present invention are disclosed herein. However, it is to be understood that the disclosed embodiments are merely exemplary of the invention that may be embodied in various and alternative forms. The figures are not necessarily to scale and some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

For simplicity and clarification, the design factors and operating principles of the gas block according to this invention are explained with reference to various exemplary embodiments of a gas block according to this invention. The basic explanation of the design factors and operating principles of the gas block is applicable for the understanding, design, and operation of the gas block of this invention. It should be appreciated that the gas block can be adapted to many applications where excessive gas pressure or blowback is experienced within a firearm.

It should also be appreciated that the terms "AR-15", "firearm", and "gas block" are used for basic explanation and understanding of the operation of the systems, methods, and apparatuses of this invention. Therefore, the terms "AR-15", "firearm", and "gas block" are not to be construed as limiting the systems, methods, and apparatuses of this invention. Thus, the terms "AR-15" and "firearm" are to be understood to broadly include any firearm having a blowback operated system.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Figure 1:
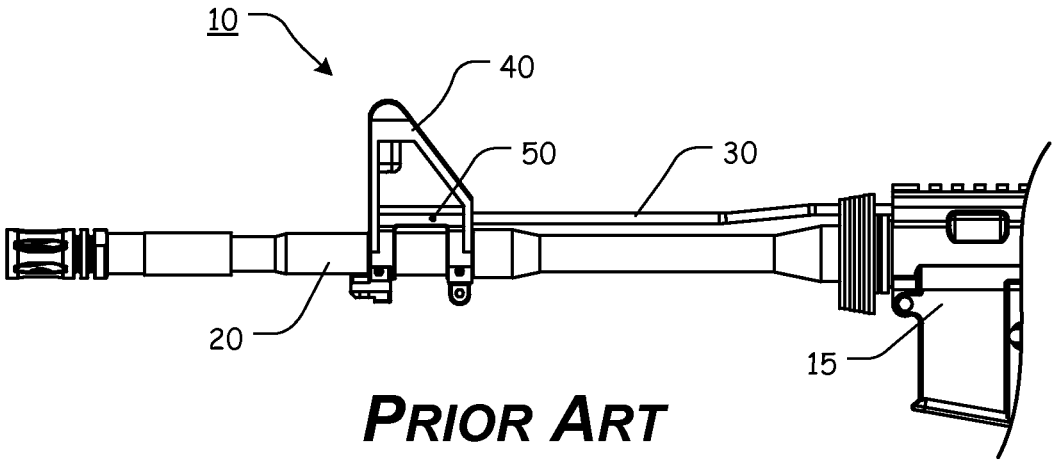
PRIOR ART FIG. 1
FIG. 1 shows a side view of a portion of a known AR-15 style barrel assembly, showing a known front sight (or gas block)
Figure 2:
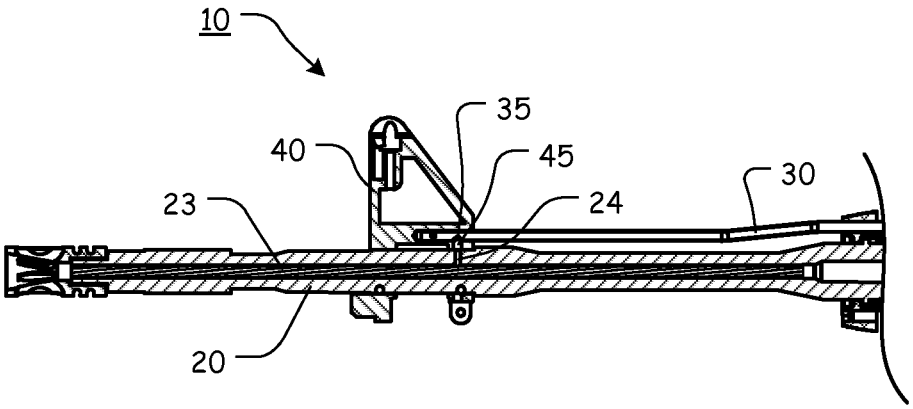
PRIOR ART FIG. 2
FIG. 2 shows a side cutaway view of a portion of a known AR-15 style barrel assembly, showing a known front sight (or gas block)
Figure 3:
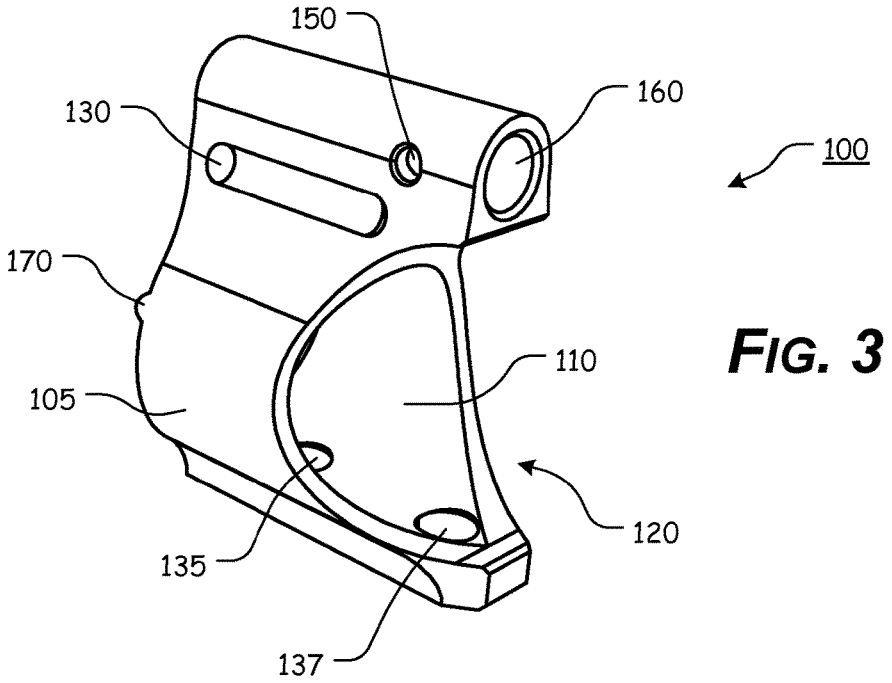
FIG. 3 shows left, front, upper, perspective view of a first exemplary embodiment of a gas block, according to this invention.
Figure 4:
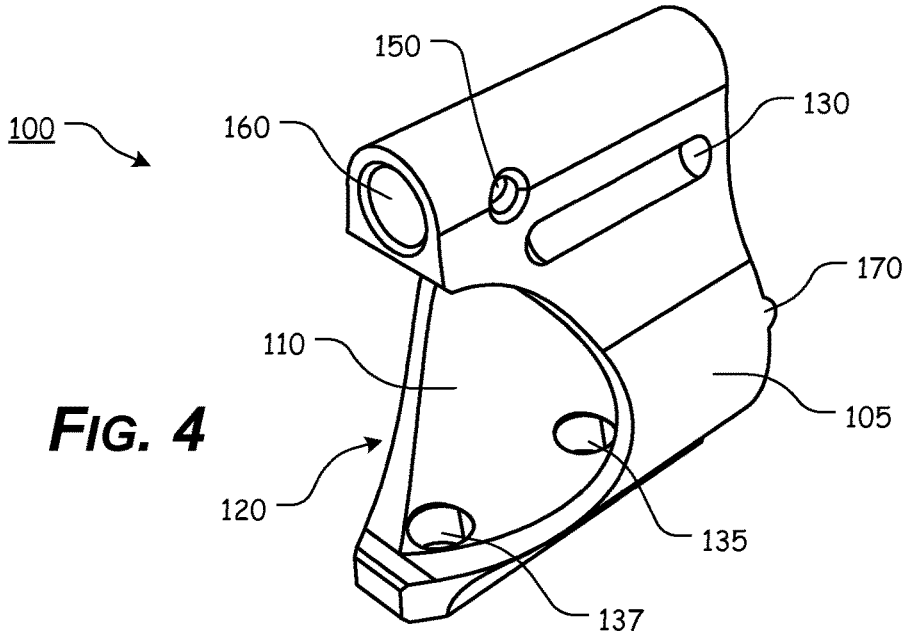
FIG. 4 shows right, front, upper perspective view of the first exemplary embodiment of a gas block, according to this invention.
Figure 5:
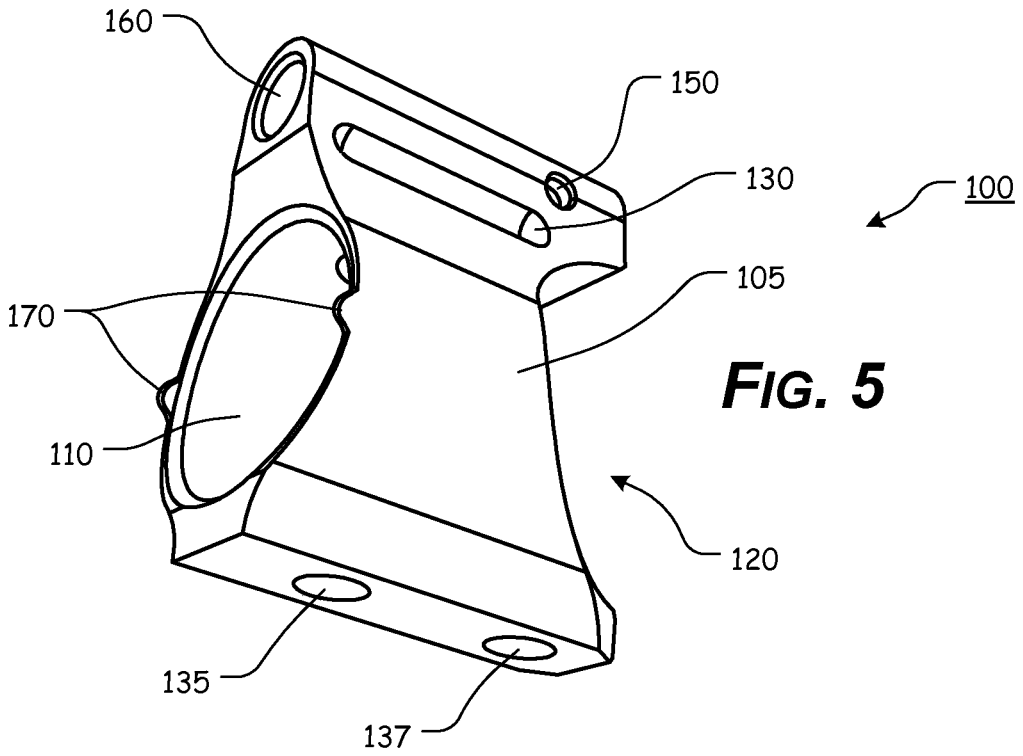
FIG. 5 shows left, rear, lower perspective view of the first exemplary embodiment of a gas block, according to this invention.
Figure 6:
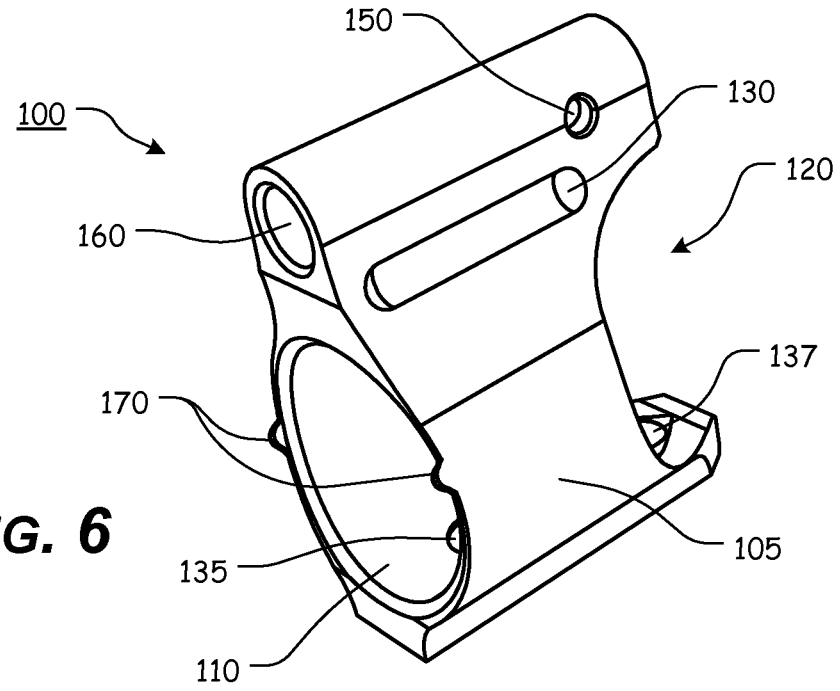
FIG. 6 shows left, rear, upper perspective view of the first exemplary embodiment of a gas block, according to this invention.
Figure 7:
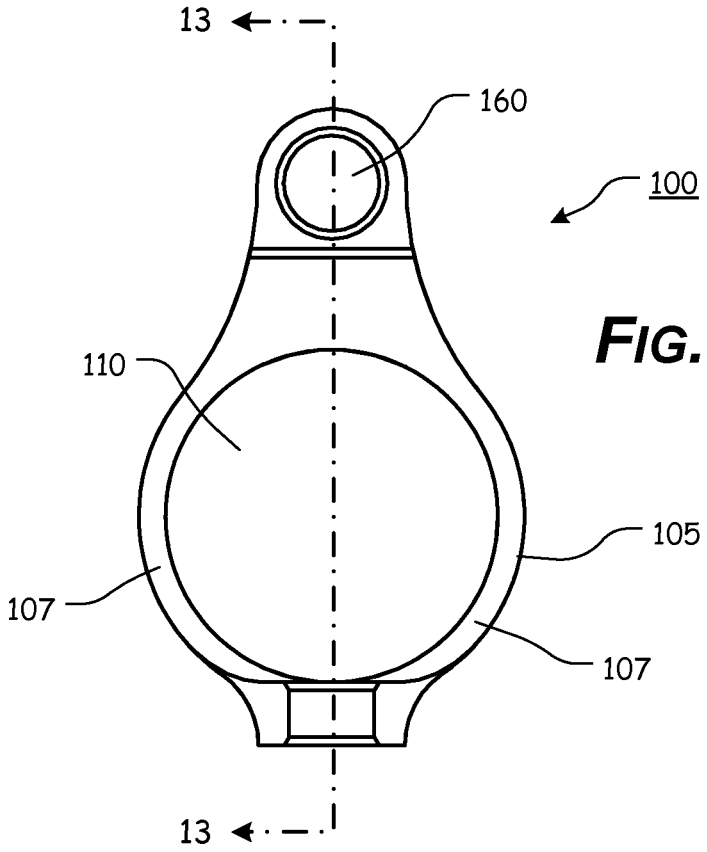
FIG. 7 shows a front view of the first exemplary embodiment of a gas block, according to this invention.
Figure 8:
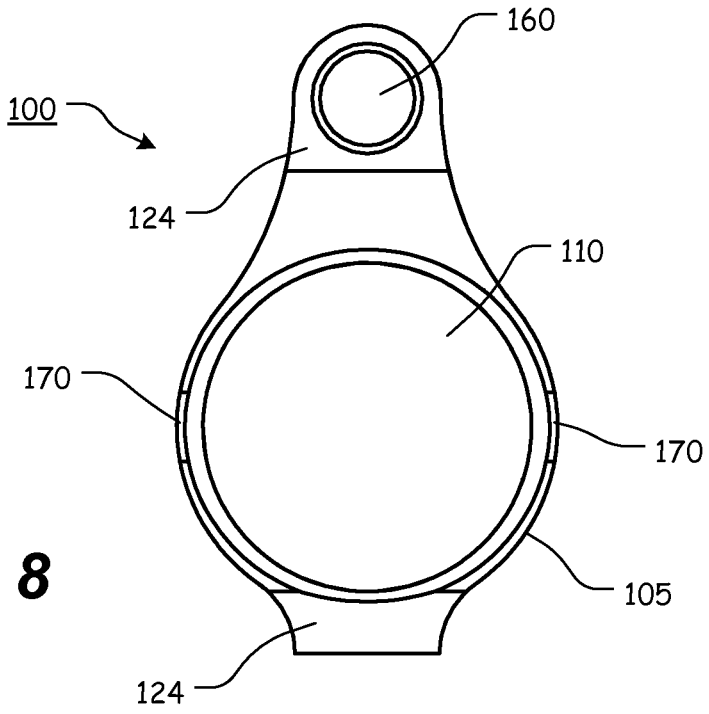
FIG. 8 shows a rear view of the first exemplary embodiment of a gas block, according to this invention.
Figure 9:
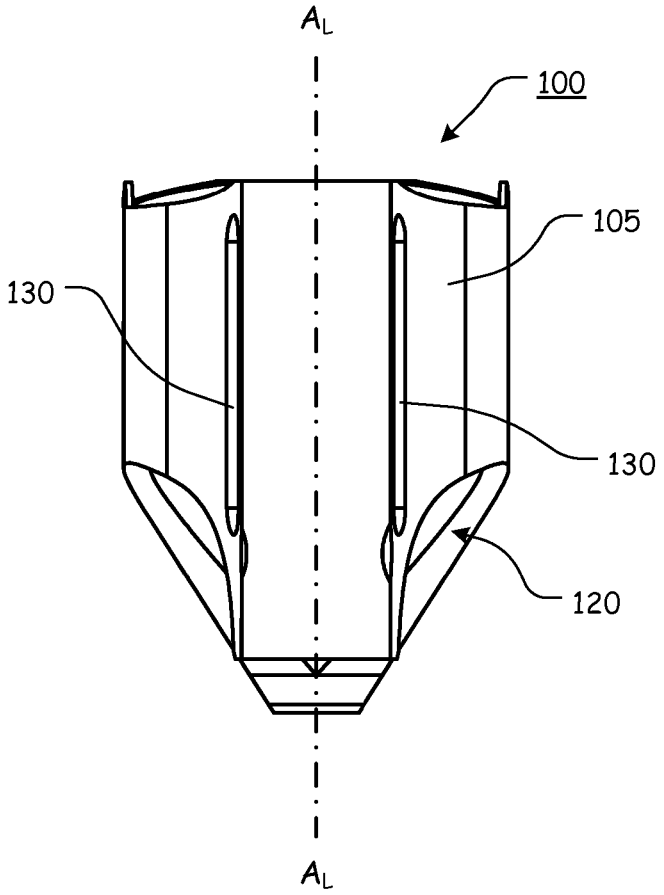
FIG. 9 shows a top view of the first exemplary embodiment of a gas block, according to this invention.
Figure 10:
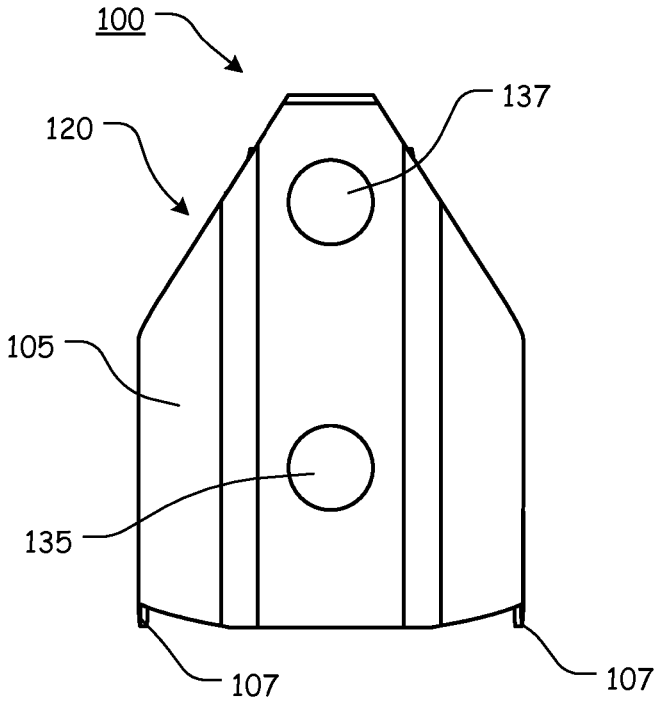
FIG. 10 shows a bottom view of the first exemplary embodiment of a gas block, according to this invention.
Figure 11:
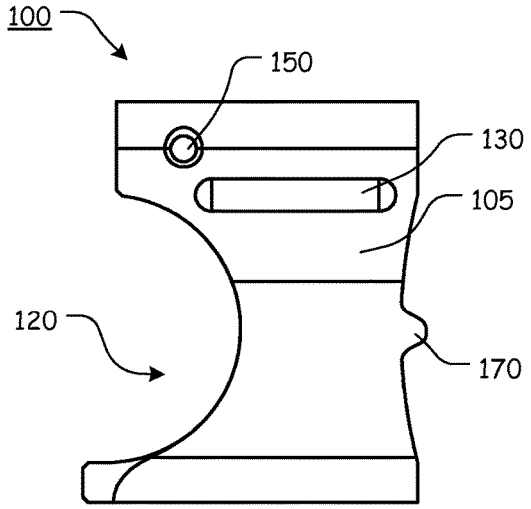
FIG. 11 shows a right side view of the first exemplary embodiment of a gas block, according to this invention.
Figure 12:
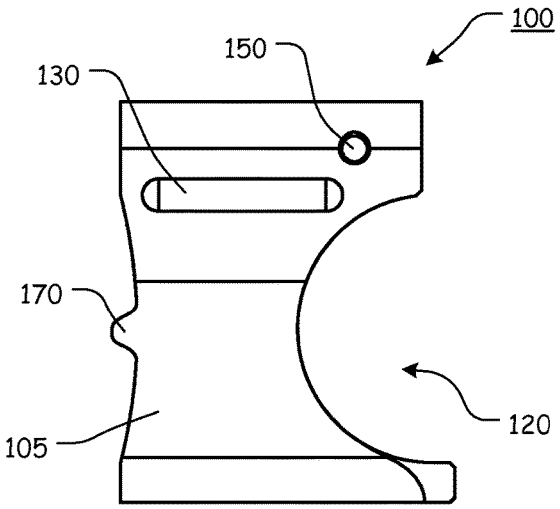
FIG. 12 shows a left side view of the first exemplary embodiment of a gas block, according to this invention.
Figure 13:
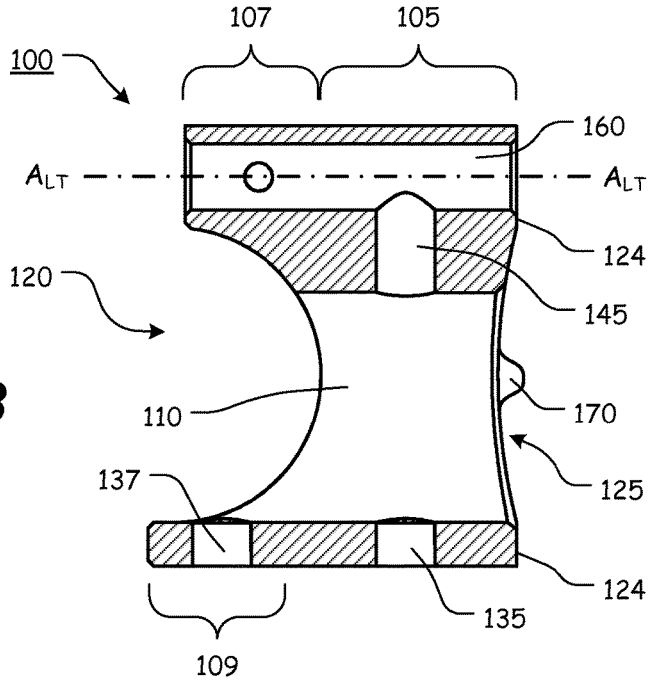
FIG. 13 shows a right side cross-sectional view taken along line 13-13 of the gas block of FIG. 7, illustrating the first exemplary embodiment of the gas block according to this invention in greater detail.

Turning now to the drawing Figs., FIGS. 1 and 2 illustrate certain elements and/or aspects of a known, exemplary AR-15 style barrel assembly 10, showing a known front sight (or gas block) 40.

Generally, the barrel assembly 10 includes a barrel 20 extending from an upper receiver 15. The barrel 20 includes a bore 23 and a barrel gas port 24. A front sight (or gas block) 40 is fitted to the barrel 20 such that a front sight gas port 45 is aligned with the barrel gas port 24 and a gas tube port 35, such that the bore 23 is in fluid communication (via barrel gas port 24, front sight gas port 45, and gas tube gas port 35) with the gas tube 30. In this manner, the barrel assembly 10 is able to operate, as described above.

It should also be appreciated that a more detailed explanation of the components of the barrel assembly 10, instructions regarding how to attach and use the various components of the barrel assembly 10, methods for installing the related components of the barrel assembly 10, and certain other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the systems, methods, and/or apparatuses as described.

FIGS. 3-15 illustrate certain elements and/or aspects of a first exemplary embodiment of a gas block 100, according to this invention. In certain illustrative, non-limiting embodiments of this invention, as illustrated in FIGS. 3-15, the gas block 100 comprises at least some of a body portion 105, wall portions 106, a gas tube extension portion 107, a body extension portion 109, a barrel borehole 110, a C-cut 120, a weight reducing groove 130, a roll pin borehole 150, a gas tube borehole 160, a first set screw aperture 135, a second set screw aperture 137, a concave surface portion 125, a gas port 145, and nodes 170.

As illustrated, the body portion 105 includes a longitudinal axis $A_L$ and a barrel borehole 110 extending through the body portion 105, along the longitudinal axis $A_L$. The barrel borehole 110 is adapted to receive at least a portion of a barrel 20 therethrough. In various exemplary embodiments, the barrel borehole 110 is adapted to receive a portion of a barrel 20 having a diameter of approximately 0.075 inches. Alternatively, the barrel borehole 110 may be adapted to receive a portion of a barrel 20 having a diameter of approximately 0.080 inches. It should be appreciated that the barrel borehole 110 may be adapted to receive a portion of a barrel 20 having any desired outer diameter.

The amount of material used to form the walls or wall segments 106 of the gas block 100, the walls 106 being formed between the surface of the body portion 105 and the surface of the barrel borehole 110 is minimized. By having thinner walls 106, the gas block 100 is able to flex during expansion and contraction of the barrel 20 without a loss of the seal between the barrel 20 and the barrel borehole 110.

A gas tube extension portion 107 extends from an upper portion of the body portion 105 and at least a portion of the gas tube extension portion 107 extends beyond at least a portion of the body portion 105. A gas tube borehole 160 extends through the gas tube extension portion 107, along the longitudinal axis $A_{LT}$ of the gas tube extension portion 107, parallel to the barrel borehole 110. The gas tube borehole 160 is adapted to receive at least a portion of a gas tube 30 therein.

A gas port 145 is disposed between the barrel borehole 110 and the gas tube borehole 160, such that the barrel borehole 110 is in fluid communication with the gas tube borehole 160.

The roll pin borehole 150 is formed through the gas tube borehole 160. The roll pin borehole 150 is formed through the gas tube borehole 160 such that a longitudinal axis of the roll pin borehole 150 is perpendicular to the longitudinal axis $A_{LT}$ of the gas tube extension portion 107.

Figure 14:
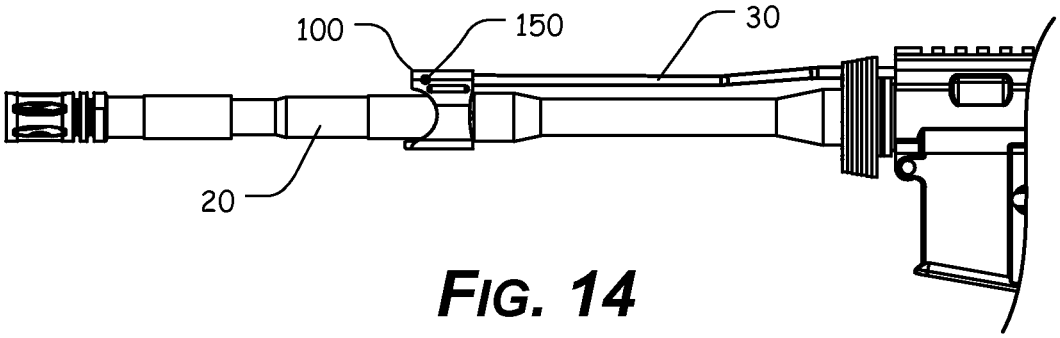
FIG. 14 shows a side view of a portion of a known AR-15 style barrel assembly, showing the known front sight (or gas block) replaced by the first exemplary embodiment of the gas block according to this invention.
Figure 15:
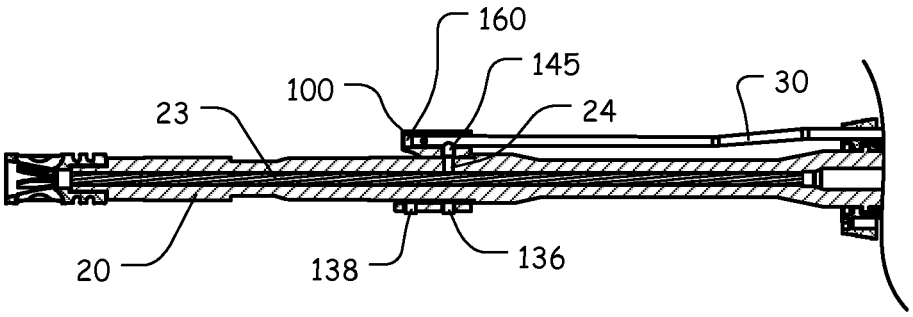
FIG. 15 shows a side cutaway view of a portion of a known AR-15 style barrel assembly, showing the known front sight (or gas block) replaced by the first exemplary embodiment of the gas block according to this invention.
Figure 16:
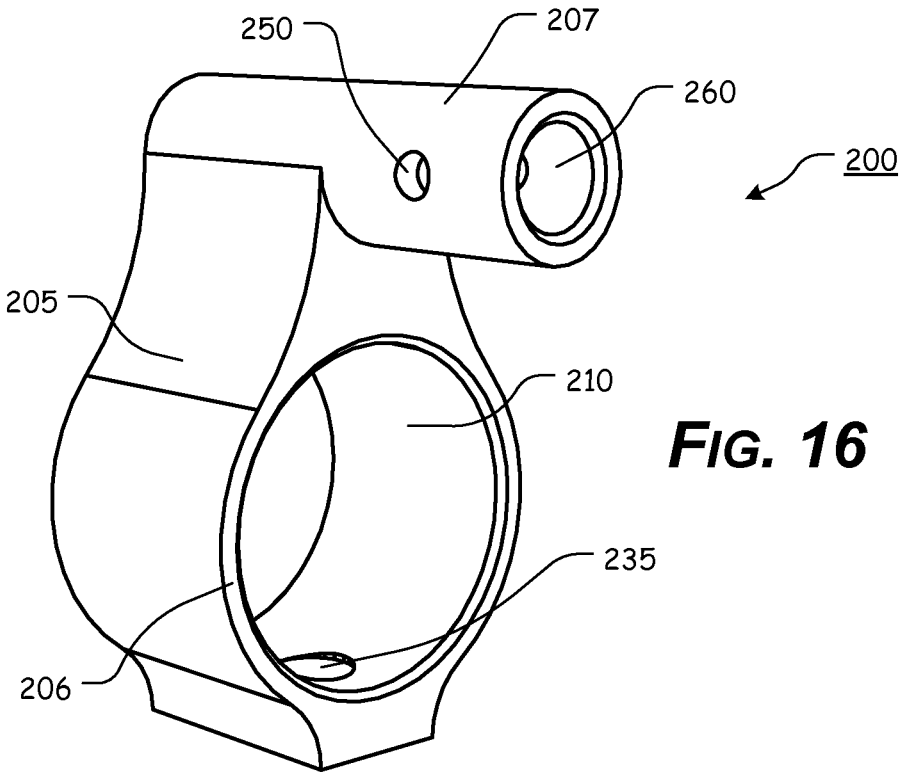
FIG. 16 shows left, front, upper, perspective view of a second exemplary embodiment of a gas block, according to this invention.
Figure 17:
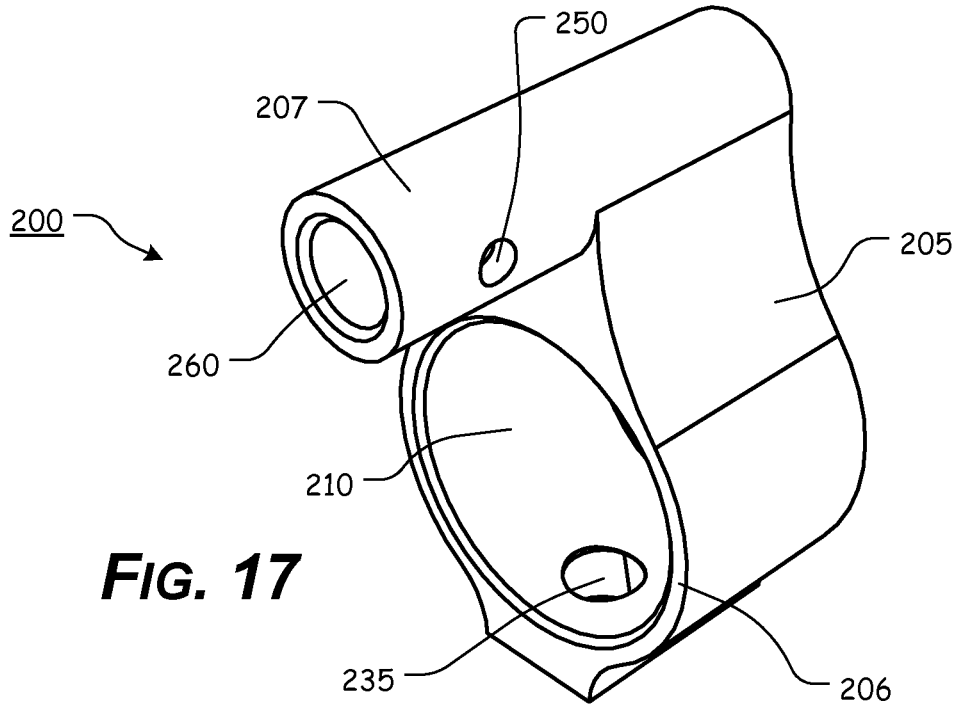
FIG. 17 shows right, front, upper perspective view of the second exemplary embodiment of a gas block, according to this invention.
Figure 18:
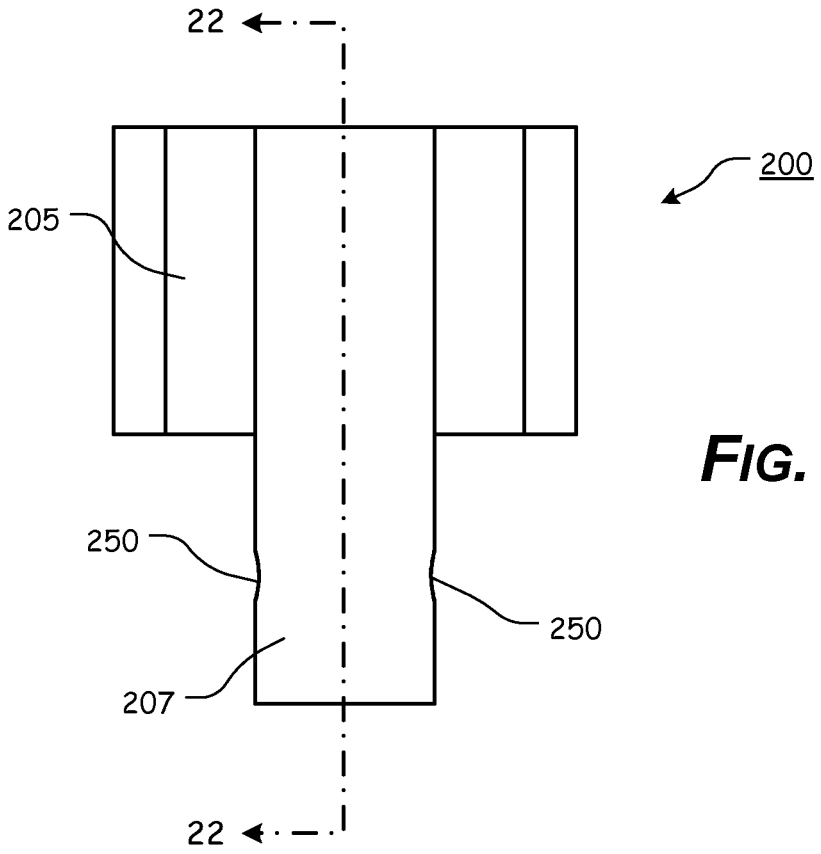
FIG. 18 shows a top view of the second exemplary embodiment of a gas block, according to this invention.
Figure 19:
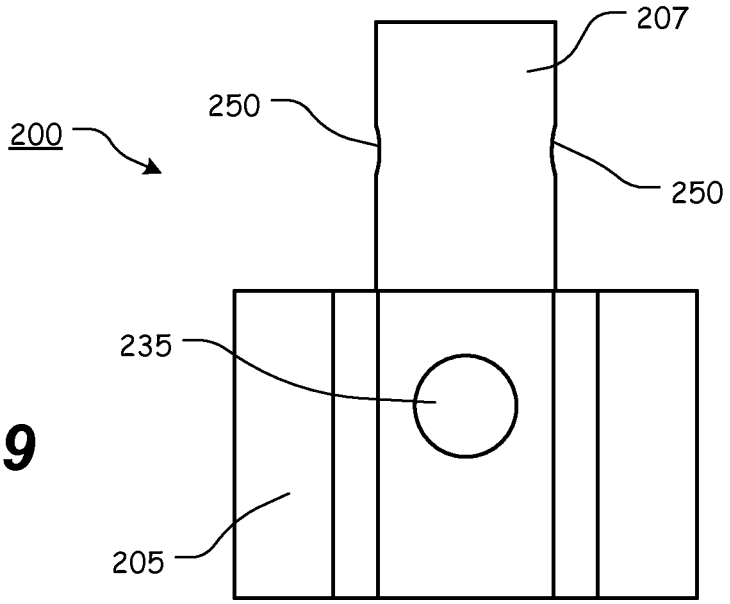
FIG. 19 shows a bottom view of the second exemplary embodiment of a gas block, according to this invention.
Figure 20:
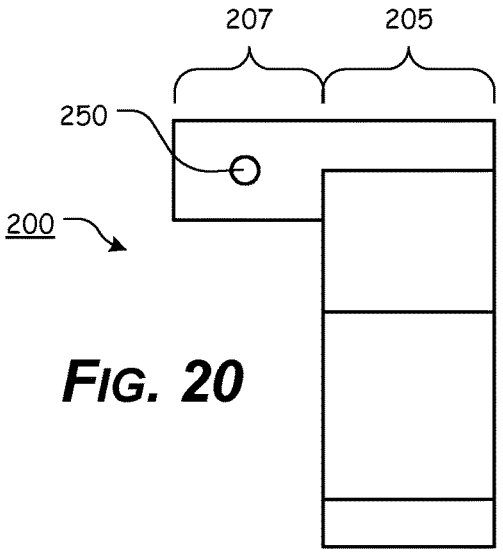
FIG. 20 shows a right side view of the second exemplary embodiment of a gas block, according to this invention.
Figure 21:
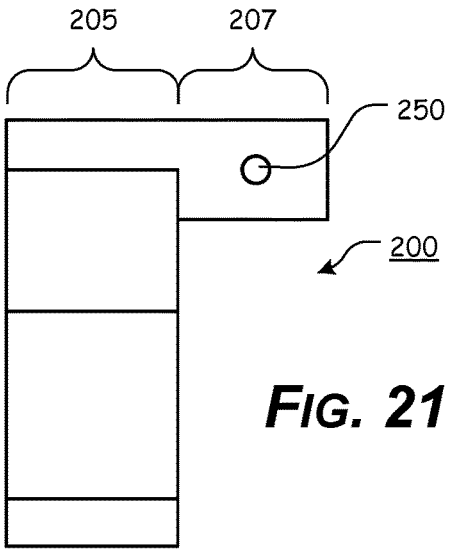
FIG. 21 shows a left side view of the second exemplary embodiment of a gas block, according to this invention.
Figure 22:
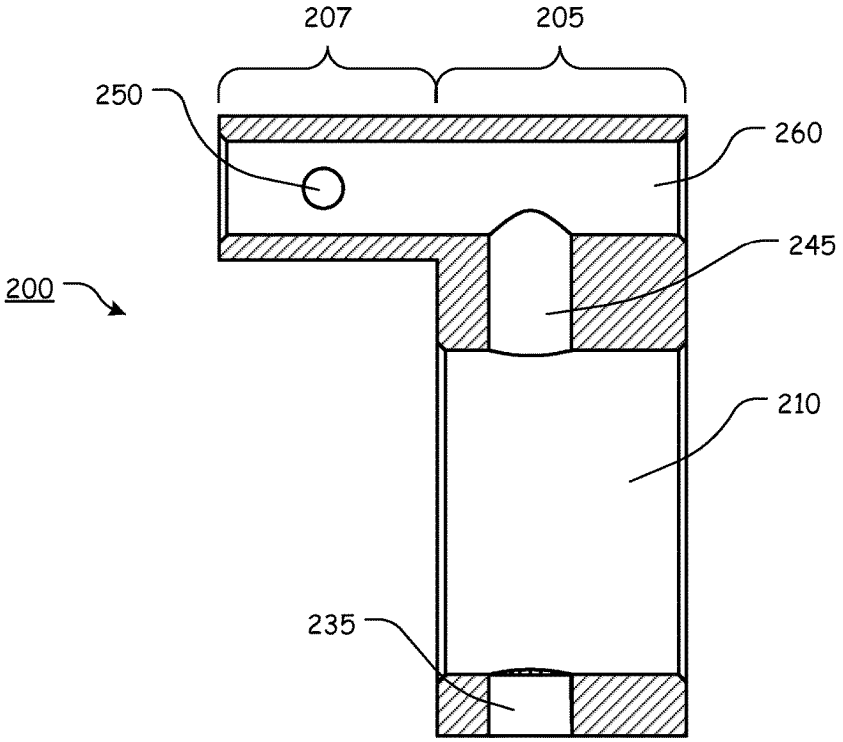
FIG. 22 shows a right side cross-sectional view taken along line 22-22 of the gas block of FIG. 18, illustrating the second exemplary embodiment of the gas block according to this invention in greater detail.

In this manner, when the gas block 100 is properly secured to a barrel 20, and a gas tube 30 is properly secured within the gas tube borehole 160, as illustrated in FIGS. 14 and 15, the barrel gas port 24 is aligned with and in fluid communication with the gas port 145 and the gas tube gas port 35 is aligned with and in fluid communication with the gas port 145, such that the bore 23 is in fluid communication (via barrel gas port 24, gas port 145, and gas tube gas port 35) with the gas tube 30.

In order to further reduce the weight of the gas block 100, at least one weight-reducing groove is formed in either side of the body portion 105. It should be appreciated that while the weight reducing groove 130 is shown as being an elongate, substantially linear groove, the weight reducing groove 130 may take any desired shape and may comprise one or more distinct grooves.

Thus, the size, shape, number, and placement of the weight reducing groove(s) 130 is a design choice based upon the desired amount of weight that is to be reduced from the gas block 100. Therefore, it should be appreciated that the weight reducing groove(s) 130 may comprise a groove on one or each of the sides of the gas block 100 or multiple apertures on one or each of the sides of the gas block 100.

Once appropriately positioned around the barrel 20, the gas block 100 may optionally be held in place by a frictional fit between the inner surface of the gas block 100 and the outer surface of the barrel 20. Alternatively, the gas block 100 may optionally include a first setscrew aperture 135 formed through the body portion 105, perpendicular to the barrel borehole 110. The inclusion of the first set screw aperture 135 allows the gas block 100 to be further secured to the barrel 20 via a first set screw 136.

In various exemplary, nonlimiting embodiments, the gas block 100 may be pinned to the barrel 20, in a manner similar to how a known front sight 40 is pinned to the barrel 20.

According to other exemplary aspects of the present invention, the gas block 100 further comprises a body extension portion 109 that extends beyond the body portion 105. In these embodiments, both the gas tube extension portion 107 and the body extension portion 109 extend beyond the body portion 105, creating a concave area or C-cut portion 120 between the gas tube extension portion 107 and the body extension portion 109.

As illustrated, the gas block 100 optionally includes a second setscrew aperture 137 formed through the body extension portion 109, perpendicular to the barrel borehole 110. The inclusion of the second set screw aperture 137 allows the gas block 100 to be further secured to the barrel 20 via a second set screw 138.

By including the concave, or C-cut portion 120, the weight of the gas block 100 is reduced so that use of the first setscrew 136 and the second setscrew 138 does not significantly increasing the overall weight of the gas block 100. Additionally, a utilizing a curved, C-cut portion 120, an increased amount of the force exerted by the first set screw 136 and the second set screw 138 on the bottom of a barrel 20 can be transferred to the upper portion of the gas block 100, forcing the top of the barrel borehole 110 down against the top of the barrel 20, creating a better seal between the top of the barrel 20 and the barrel borehole 110, resulting in a better seal between the barrel gas port 23 and the gas port 145 of the gas block 100.

Optionally, a first end of the body portion includes a planar surface portion 124 and a concave surface portion 125. A surface of the concave surface portion 125 is perpendicular to the longitudinal axis $A_L$ of the body portion 105.

If a concave surface portion 125 is included, at least two nodes 170 may optionally be included that extend from the surface of the concave surface portion 125. The nodes 170 extend to a plane created by the planar surface portions 124 of the first end of the gas block 100. The nodes 170 create additional areas points along the planar surface portion 124 to help hold a handguard retainer ring or cap, if utilized. If the nodes 170 are not included, the planar surface portions 124 would typically only contact the handguard retainer ring or cap a 12 o'clock and a six o'clock position. With the addition of the nodes 170, the planar surface portions 124 would contact the handguard retainer ring or cap at or near the 12 o'clock and six o'clock positions, while the nodes 170 would also contact the retainer ring or cap at or near the three o'clock and nine o'clock positions.

In various exemplary embodiments, various components of the gas block 100 are substantially rigid and are formed of titanium. Alternate materials of construction of the various components of the gas block 100 may include one or more of the following: steel, aluminum, stainless steel, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the gas block 100 is a design choice based on the desired appearance and functionality of the gas block 100.

It should be appreciated that certain elements of the gas block 100 may be formed as an integral unit (such as, for example, the body portion 105 and the gas tube extension portion 107). Alternatively, suitable materials can be used and sections or elements made independently and attached or coupled together, such as by adhesives, welding, screws, rivets, pins, or other fasteners, to form the various elements of the gas block 100.

It should also be understood that the overall size and shape of the gas block 100 and the various portions thereof is a design choice based upon the desired functionality and/or appearance of the gas block 100.

FIGS. 16-24 illustrate certain elements and/or aspects of a second exemplary embodiment of a gas block 200, according to this invention. In certain illustrative, non-limiting embodiments of this invention, as illustrated in FIGS. 3-15, the gas block 200 comprises at least some of a body portion 205, wall portions 206, a gas tube extension portion 207, a barrel borehole 210, a roll pin borehole 250, a gas tube borehole 260, a first set screw aperture 235, a first set screw 236, a concave surface portion 225, and a gas port 245.

It should be understood that each of these elements corresponds to and operates similarly to the body portion 105, wall portions 106, the gas tube extension portion 107, the barrel borehole 110, the roll pin borehole 150, the gas tube borehole 160, the first set screw aperture 135, the first set screw 136, the concave surface portion 125, and the gas port 145, as described above with reference to the gas block 100 of FIGS. 3-15.

Figure 23:
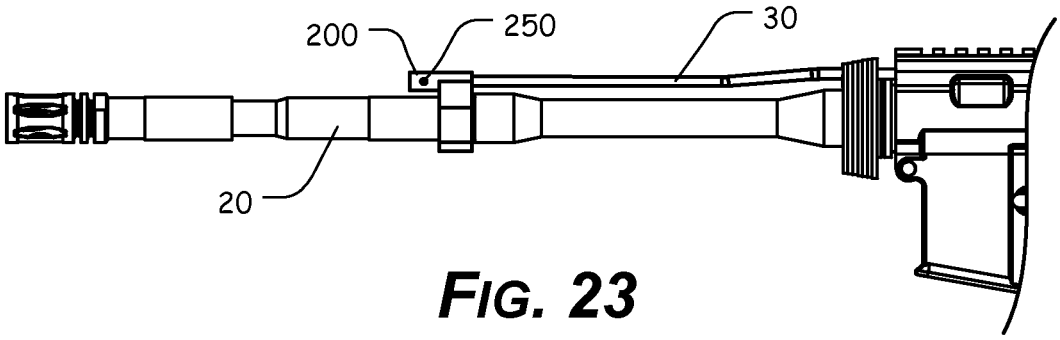
FIG. 23 shows a side view of a portion of a known AR-15 style barrel assembly, showing the known front sight (or gas block) replaced by the second exemplary embodiment of the gas block according to this invention.
Figure 24:
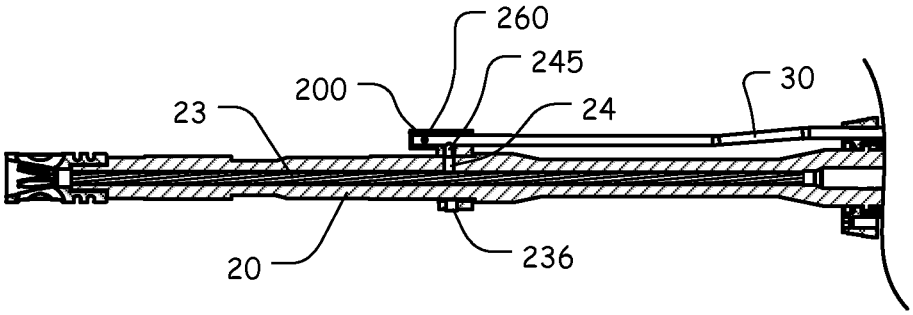
FIG. 24 shows a side cutaway view of a portion of a known AR-15 style barrel assembly, showing the known front sight (or gas block) replaced by the second exemplary embodiment of the gas block according to this invention.

However, as illustrated in FIGS. 16-24, the gas block 200 does not include a body extension portion substantially equivalent to the body extension portion 109. Since the body extension portion is not included in the gas block 200, the gas tube extension portion 207 extends beyond the body portion 105 and overhangs a portion of the barrel 20, when installed, as illustrated in FIGS. 23 and 24.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

It is also noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A gas block for a firearm, comprising:

a body portion extending along a longitudinal axis;

a barrel borehole extending through said body portion, substantially parallel to said longitudinal axis of said body portion, wherein said barrel borehole is adapted to receive at least a portion of a barrel therethrough;

a gas tube extension portion having a longitudinal axis, wherein at least a portion of said gas tube extension portion extends beyond at least a portion of said body portion;

a gas tube borehole extending through at least a portion of said gas tube extension portion, along said longitudinal axis of said gas tube extension portion, wherein said gas tube borehole is substantially parallel to said barrel borehole, and wherein said gas tube borehole is adapted to receive at least a portion of a gas tube therein;

a gas port disposed between said barrel borehole and said gas tube borehole, such that at least a portion of said barrel borehole is in fluid communication with at least a portion of said gas tube borehole;

a body extension portion having a longitudinal axis, wherein said body extension portion extends beyond at least a portion of said body portion; and a substantially C-cut portion extending between at least a portion of said gas tube extension portion and at least a portion of said body extension portion, wherein said substantially C-cut portion has foci on a longitudinal axis, and wherein at least a portion of said gas tube extension portion or at least a portion of said body extension portion is adapted to contact at least an exterior portion of said barrel, if said portion of said barrel is positioned through said barrel borehole, said foci lies within said barrel.

2. The gas block of claim 1, further comprising a roll pin borehole formed through said gas tube borehole, wherein a longitudinal axis of said roll pin borehole is substantially perpendicular to said longitudinal axis of said gas tube extension portion.

3. The gas block of claim 1, further comprising at least one weight-reducing groove formed in at least said body portion.

4. The gas block of claim 1, further comprising a first set screw aperture formed through said body portion, wherein said first set screw aperture is formed substantially perpendicular to said barrel borehole longitudinal axis.

5. The gas block of claim 1, wherein said substantially C-cut portion comprises a concave or curved, C-cut portion.

6. The gas block of claim 4, further comprising a second set screw aperture, wherein said second set screw aperture is formed through said body extension portion, substantially perpendicular to said barrel borehole longitudinal axis.

7. The gas block of claim 1, wherein said C-cut portion provides a radiused transition between said gas tube extension portion and said body extension portion.

8. The gas block of claim 1, wherein a first end of said body portion includes a substantially planar surface portion and a substantially concave surface portion, wherein a surface of said substantially concave surface portion is substantially perpendicular to said longitudinal axis of said body portion.

9. The gas block of claim 8, further comprising at least two nodes extending from said surface of said concave surface portion, wherein said nodes extend to said planar surface portion of said first end of said gas block.

10. A gas block for a firearm, comprising: a body portion extending along longitudinal axis, wherein a first end of said body portion includes a substantially planar surface portion and a substantially concave surface portion, and wherein a surface of said substantially concave surface portion is perpendicular to said longitudinal axis of said body portion; a barrel borehole extending through said body portion, substantially along said longitudinal axis of said body portion, wherein said barrel borehole is adapted to receive at least a portion of a barrel therethrough; a gas tube extension portion having a longitudinal axis, wherein at least a portion of said gas tube extension portion extends beyond at least a portion of said body portion; a gas tube borehole extending through at least a portion of said gas tube extension portion, substantially along said longitudinal axis of said gas tube extension portion, wherein said gas tube borehole is substantially parallel to said barrel borehole, and wherein said gas tube borehole is adapted to receive at least a portion of a gas tube therein; a gas port disposed between said barrel borehole and said gas tube borehole, such that at least a portion of said barrel borehole is in fluid communication with at least a portion of said gas tube borehole; a body extension portion, wherein at least a portion of said body extension portion extends beyond at least a portion of said body portion; and a substantially C-cut portion formed between at least a portion of said gas tube extension portion and at least a portion of said body extension portion, wherein said substantially C-cut portion has foci on a longitudinal axis, and wherein at least a portion of said gas tube extension portion or at least a portion of said body extension portion is adapted to contact at least an exterior portion of said barrel, if said portion of said barrel is positioned through said barrel borehole, said foci lies within said barrel.

11. The gas block of claim 10, further comprising a roll pin borehole formed through said gas tube borehole, wherein a longitudinal axis of said roll pin borehole is substantially perpendicular to said longitudinal axis of said gas tube extension portion.

12. The gas block of claim 11, further comprising at least one weight-reducing groove formed in at least a portion of said body portion.

13. The gas block of claim 10, further comprising at least two nodes, wherein each of said nodes extends from said surface of said substantially concave surface portion, and wherein each of said nodes extends to said substantially planar surface portion of said first end of said gas block.

14. The gas block of claim 10, further comprising a first set screw aperture formed through said body portion, wherein said first set screw aperture is formed substantially perpendicular to said barrel borehole longitudinal axis.

15. The gas block of claim 10, further comprising a second set screw aperture, wherein said second set screw aperture is formed through said body extension portion, and wherein said second set screw aperture is formed substantially perpendicular to said barrel borehole.

16. A gas block for a firearm, comprising: a body portion extending along longitudinal axis, wherein a first end of said body portion includes a planar surface portion and a concave surface portion; at least one set screw aperture formed through said body portion, wherein said at least one screw aperture is formed perpendicular to said barrel borehole; a barrel borehole extending through said body portion, along said longitudinal axis of said body portion, wherein said barrel borehole is adapted to receive at least a portion of a barrel therethrough; a gas tube extension portion having a longitudinal axis, wherein at least a portion of said gas tube extension portion extends beyond at least a portion of a second end of said body portion; a gas tube borehole extending through at least a portion of said gas tube extension portion, along said longitudinal axis of said gas tube extension portion, wherein said gas tube borehole is parallel to said barrel borehole, and wherein said gas tube borehole is adapted to receive at least a portion of a gas tube therein; a gas port disposed between said barrel borehole and said gas tube borehole, such that at least a portion of said barrel borehole is in fluid communication with at least a portion of said gas tube borehole; a body extension portion extending beyond at least a portion of said second end of said body portion and extending beyond at least a portion of said gas tube extension portion; and a substantially C-cut portion formed between at least a portion of said gas tube extension portion and at least a portion of said body extension portion, wherein said substantially C-cut portion has foci on a longitudinal axis, and wherein at least a portion of said gas tube extension portion or at least a portion of said body extension portion is adapted to contact at least an exterior portion of said barrel, if said portion of said barrel is positioned through said barrel borehole, said foci lies within said barrel.

17. The gas block of claim 16, wherein a surface of said concave surface portion is perpendicular to said longitudinal axis of said body portion, and wherein at least two nodes extend from said surface of said concave surface portion.

18. The gas block of claim 16, further comprising at least two set screw apertures, wherein each of said set screw apertures is formed through said body extension portion, and wherein each of said set screw apertures is formed perpendicular to said barrel borehole longitudinal axis.

* * * * *